US005790984A

United States Patent [19]

Doubleday

[11] Patent Number: 5,790,984

[45] Date of Patent: Aug. 11, 1998

[54] JUMPSUIT AND UNDERGARMENT

[76] Inventor: Jennifer Doubleday, 4716 White Tail La., Sarasota, Fla. 34238

[21] Appl. No.: 818,701

[22] Filed: Mar. 14, 1997

[51] Int. Cl.[6] ..... A41D 1/06

[52] U.S. Cl. ..... 2/69; 2/227; 2/228; 2/238; 2/408; 2/78.2; 2/79

[58] Field of Search ..... 2/69.79, 227, 228, 2/238, 73, 78.1, 78.2, 78.3, 80, 83, 400, 402, 403, 404, 405, 406, 407, 408, 234; 450/102, 103, 105

[56] References Cited

U.S. PATENT DOCUMENTS

| | | | |
|---|---|---|---|
| 3,956,774 | 5/1976 | Spaulding | 2/79 |
| 4,914,756 | 4/1990 | Grassick | 2/227 |
| 5,010,595 | 4/1991 | Stradley | 2/227 |

FOREIGN PATENT DOCUMENTS

| | | | |
|---|---|---|---|
| 1090076 | 3/1955 | France | 2/227 |
| 1431107 | 1/1966 | France | 2/227 |
| 432391 | 7/1935 | United Kingdom | 2/408 |
| 2127276 | 4/1984 | United Kingdom | 2/227 |

*Primary Examiner*—Gloria M. Hale
*Attorney, Agent, or Firm*—Charles J. Prescott

[57] ABSTRACT

A substantially unitary outer garment of the type worn by women generally known as a jump suit having a concealed closeable opening which facilitates urination by the wearer without need for removal or undoing of the outer garment. The closeable opening extends only through the crotch area along the inseam of the outer garment and is only of sufficient length to permit being manually spread open by the wearer to facilitate urination from either a standing position or while seated on a toilet. When worn, an improved undergarment worn by the wearer beneath the outer garment is also provided which includes a similarly positioned and sized closeable opening positioned in alignment with the closeable opening of the outer garment.

4 Claims, 3 Drawing Sheets

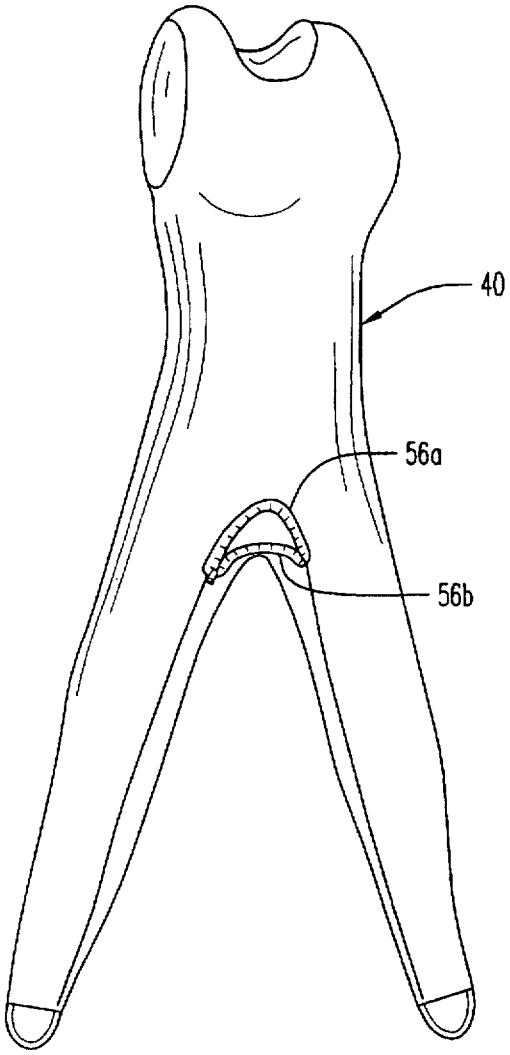
FIG. 3
FIG. 4
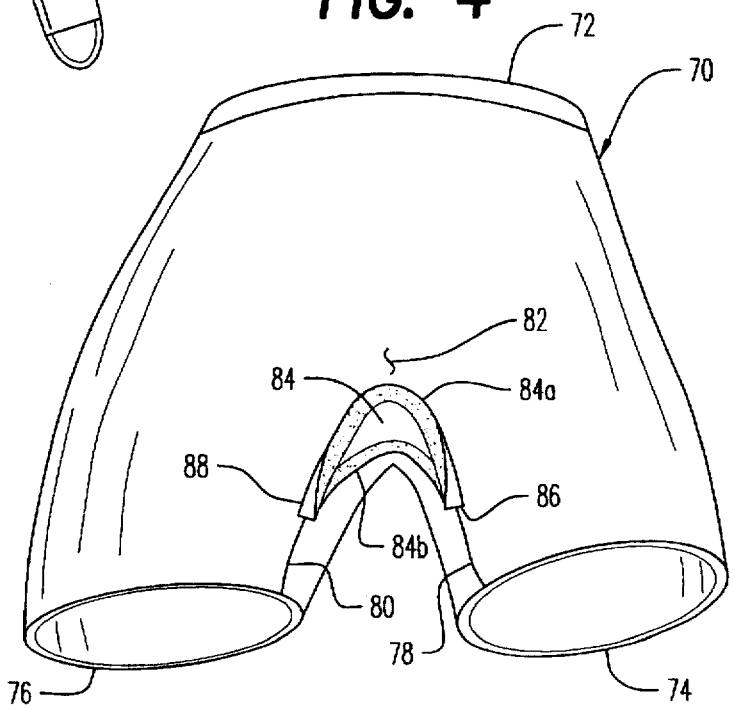

JUMPSUIT AND UNDERGARMENT

BACKGROUND OF THE INVENTION

1. Scope of Invention

This invention relates generally to women's clothing, and particularly to unitary jumpsuits and undergarments which facilitate urination without removal thereof.

2. Prior Art

Many women's outer garments are in the form of a substantially unitary jumpsuit type for both summer and winter wear which covers both the upper and lower torso and legs and sometimes the arms of the female wearer. In order for the wearer of such outer garments to urinate, typically at least the upper portion of such outer garments must be removed before being seated atop a toilet. When traveling in remote areas and around the world, many toilet facilities are extremely unsanitary at best and may not even provide a toilet or commode atop which to be seated. In such circumstance, normal jumpsuit and outer garments and other articles of clothing are difficult to deal with to facilitate urination.

One prior art outer garment known to applicant facilitates a woman urinating when outdoors as disclosed in U.S. Pat. No. 4,604,761. Wright discloses in this patent an outdoor sportswear garment in the form of trousers which includes a yoke permanently attached at the back of the waistband which is removable to uncover a front opening which extends generally from the crotch region to the front of the waistband. While being somewhat functional for the intended purpose and circumstance, the arrangement is not at all concealed when not in use and would clearly be inappropriate for many types of outer garments.

Smith, in U.S. Pat. No. 5,008,962 teaches trousers which include two separately openable seams extending from an upper margin to the hem edge of the trousers and is thus only structured to facilitate easily positioned and removed trousers for patients.

A jumpsuit is disclosed in U.S. Pat. No. 4,447,911 taught by Marcellaro which includes hidden access flaps in the seat portion which allow the wearer to use toilet facilities without complete removal of the garment.

Applicant is also aware of the following U.S. Patents which are somewhat more structurally and functionally distant from the present invention than those described hereinabove as follows:

| | |
|---|---|
| Bredo | 4,392,259 |
| Sampey | 3,994,026 |
| Won | 4,619,004. |

The present invention provides a substantially unitary jumpsuit which includes a closeable opening extending only a short distance along the inseam through the crotch area and being centrally positioned with respect to the crotch area. The concealed opening is manually openable to facilitate urination while the women wearer is either in a standing or seated position atop the toilet. Otherwise, the opening is concealed from view when in its closed configuration. A matching undergarment is also provided, when worn, having its own separate closeable opening which also extends along the inseam centrally spaced through the crotch area so as to be substantially aligned with the closeable opening of the outer garment. Both openings are of only sufficient length to facilitate manual spreading of the openings during urination.

BRIEF SUMMARY OF THE INVENTION

This invention is directed to a substantially unitary outer garment of the type worn by women generally known as a jump suit having a concealed closeable opening which facilitates urination by the wearer without need for removal or undoing of the outer garment. The closeable opening extends only through the crotch area along the inseam of the outer garment and is only of sufficient length to permit being manually spread open by the wearer to facilitate urination from either a standing position or while seated on a toilet. When worn, an improved undergarment worn by the wearer beneath the outer garment is also provided which includes a similarly positioned and sized closeable opening positioned in alignment with the closeable opening of the outer garment.

It is therefore an object of this invention to provide a jumpsuit type outer garment which easily facilitates urination by a woman wearer when either in a standing or seated position atop a toilet and which is otherwise concealed when not in use.

It is still another object of this invention to provide an undergarment covering only the lower torso of the woman wearer which is intended for use separately or preferably in combination with the above described jumpsuit type outer garment wherein both garments include closeable openings which extend in aligned fashion substantially along the inseam of each garment only through the central crotch area.

It is yet another object of this invention to provide a combination of an outer jumpsuit type garment which covers the upper and lower torso of the wearer and an undergarment which covers the lower torso of the wearer, both of which include closeable openings extending through the crotch area and along the inseam to facilitate urination from either a standing or a seated position atop a toilet.

In accordance with these and other objects which will become apparent hereinafter, the instant invention will now be described with reference to the accompanying drawings.

BRIEF DESCRIPTION OF THE DRAWINGS

FIG. 3 is a perspective view of FIG. 2 with the closeable opening in an open ready for use configuration.

FIG. 4 is a perspective view of an undergarment of the present invention with the closeable opening in a ready for use configuration.

DETAILED DESCRIPTION OF THE INVENTION

Figure 1:
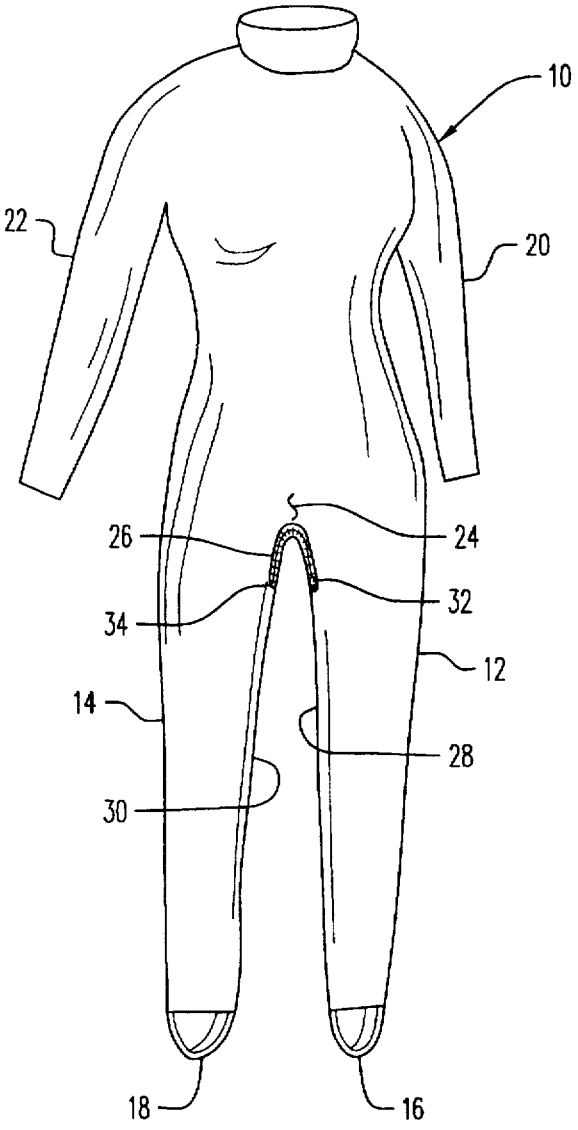
FIG. 1 is a perspective view of one embodiment of a jumpsuit type outer garment of the invention.

Referring now to the drawings, one embodiment of a jumpsuit type outer garment is shown generally at numeral 10 in accordance with the present invention. This outer garment 10 is substantially unitary in the form covering substantially the entire lower and upper torso of a woman wearer thereof and further includes sleeves 20 and 22 and full length pant legs 12 and 14. The pant legs 12 and 14 typically include foot loops 16 and 18 which are stretched over the bottom of each foot so as to maintain an extended and taught appearance to the pant legs 12 and 14.

Inseams 28 and 30 extend along the inner most portion of each pant leg 12 and 14 and through the central crotch area 24. A closeable opening 26 extends along each of the inseams 28 and 30, but only through this central crotch area 24 of the garment 10. The closeable opening 26 terminates at 32 and 34, in this instance is made closeable by a conventional zipper of standard 9" or 12" being preferred. When in the closed configuration, the closeable zippered opening 26 is generally concealed from view in the configuration shown in FIG. 1.

Figure 2:
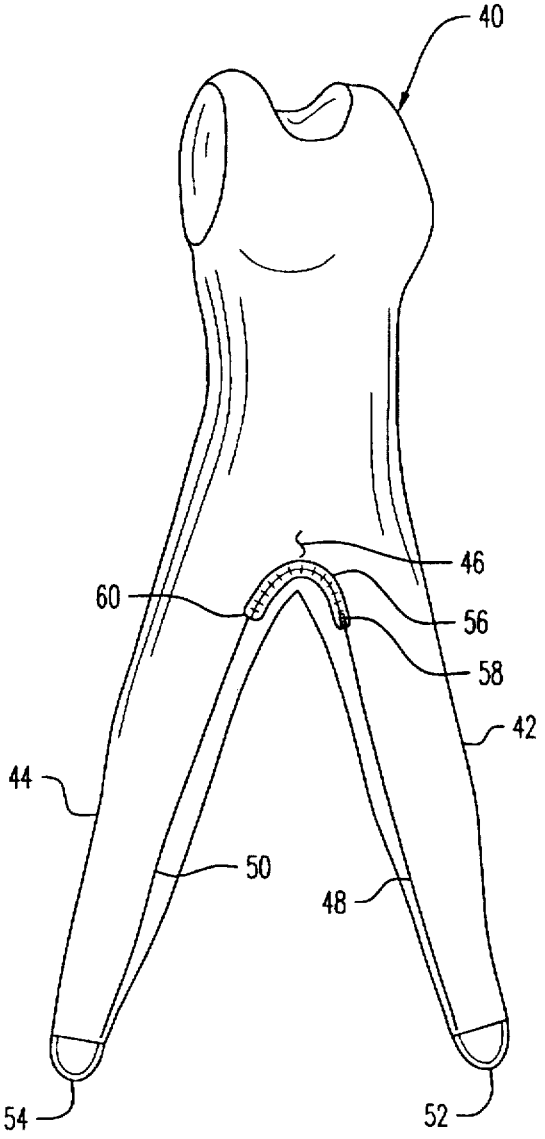
FIG. 2 is a perspective view of another embodiment of a jumpsuit type outer garment of the present invention.

Another embodiment of the invention is shown generally at numeral 40 in FIG. 2 also in the form of a substantially unitary jumpsuit type outer garment which covers both upper and lower torso and legs of the female wearer as well. In this embodiment 40, which is sleeveless, the pant legs 44 and 48 have foot loops 52 and 54 which function as previously described. Inseams 48 and 50 extend in aligned, substantially continuous fashion from the central crotch area 46 and are made openable in the crotch area between the ends 58 and 60 of a zippered opening 56 which is shown in the closed configuration. Again, except for the characterization shown for clarity in FIG. 2, this closeable zippered opening 56 is concealed when in the closed configuration.

In FIG. 3, the jumpsuit embodiment 40 shown in FIG. 2 is depicted with the closeable zippered opening in an open configuration wherein margins 56*a* and 56*b* are spread apart manually a distance sufficient to facilitate urination by the female wearer in either a standing position somewhat as shown or in a seated position atop a toilet.

Figure 5:
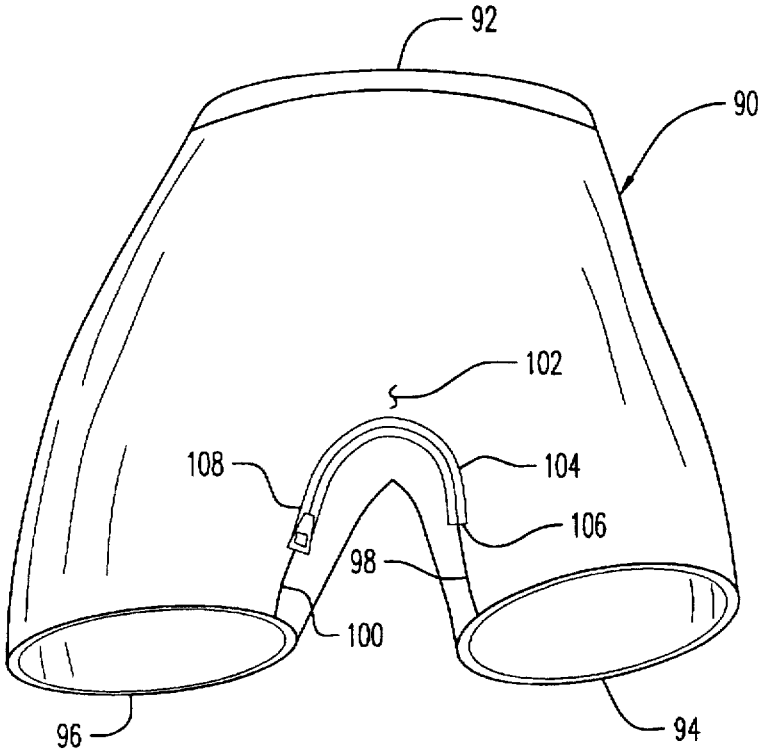
FIG. 5 is a view of FIG. 4 with the closeable opening in a closed configuration.
Figure 6:
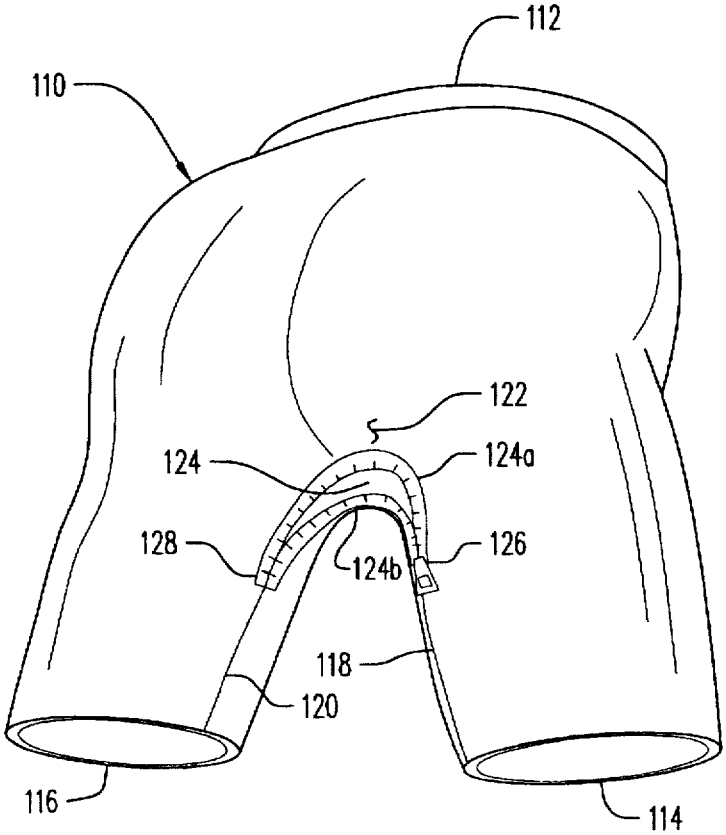
FIG. 6 is a rear perspective view of another embodiment of an undergarment of the present invention with the closeable opening in its open ready for use configuration.

Referring now to FIGS. 4, 5 and 6, typically an undergarment is also worn beneath a jumpsuit type outer garment such as is shown in FIGS. 1 to 3. To facilitate the usefulness of the improved outer garments 10 and 40, such undergarments must also provide cooperative opening structure to accommodate the closeable opening provided in these outer garments 10 and 40. In FIG. 4, one such undergarment is shown at numeral 70 and includes a main body portion which covers a substantial portion of the lower torso of the female wearer thereof, terminating at waist opening 72 and extending downwardly to cover a portion of each upper leg ending at leg openings 74 and 76. A closeable opening 84 shown in the open configuration in the crotch area 82 and extending along inseams 78 and 80 is there shown. The closeable opening 84 is formed of mating two part VELCRO margins 84*a* and 84*b* which terminate at 86 and 88. In this open configuration, effected by manual grasping of each margin 84*a* and 84*b*, the female user may then easily urinate from either a standing or seated position atop a toilet seat.

The embodiment shown generally at numeral 90 in FIG. 5 is generally structured as an undergarment for women similar to that shown in FIG. 4. However, in this embodiment 90 which includes an upper waist opening 92 and leg openings 94 and 96, a zippered closeable opening 104 shown in its closed configuration extends centrally from the crotch area 102 along the upper portions of each of the inseams 98 and 100. In the closed configuration shown, the zippered closeable opening 104 is substantially concealed from view.

Another embodiment of a unitary undergarment is shown in FIG. 6 generally at numeral 110. In this embodiment 110, which may typically be an undergarment for women such as a somewhat tight fitting panty girdle covers a substantial portion of the lower torso from waist opening 112 down to mid length leg openings 114 and 116. A zippered closeable opening 124 shown with its mating zippered margins 124*a* and 124*b* manually spread to the open configuration, terminates at 126 and 128 on either side of the crotch area 122. Here again, the zippered closeable opening 124 extends only a short distance along the inseams 118 and 120 centrally on either side of the crotch area 122. When in the open configuration shown in FIG. 6, the opening 124 facilitates urination.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In a substantially unitary pants-suit type outer garment for women which covers the upper and lower torso of the female wearer and having an upper neck opening and arm openings or sleeves and pant legs, said pant legs each having a hem edge and an inseam which extends from a central crotch area to said hem edge, the improvement comprising:

a closeable opening extending along said inseam centrally positioned through said crotch area, said closeable opening terminating before reaching said hem edge so that said hem edge is substantially continuous and uninterrupted, whereby said closeable opening is only of sufficient length to permit the wearer to urinate through said opening while either standing or while resting atop a toilet without further removal or further opening of said outer garment said closeable opening otherwise being substantially concealed from view when closed.

2. An improved substantially unitary undergarment for women which covers the lower torso of the female wearer and having a waist opening and pant legs which extend below a crotch area to cover at least a portion of each upper leg of the wearer, said pant legs each having an inseam which extends from said crotch area downwardly to a lower hem edge of each said pant leg, said garment comprising:

a unitary lower torso undergarment having a closeable opening which extends along only a portion of the inseam substantially centrally on either side of the crotch area, said closeable opening extending toward but not to, each said hem edge, said closeable opening thereby having a maximum length sufficient to permit the wearer to urinate through said closeable opening without the need for even partial removal or further dismantling of said undergarment and leaving each said leg hem continuous and uninterrupted.

3. For a somewhat tight-fitting unitary undergarment of the type worn by women to cover the lower torso and upper legs and having a waist opening and pant legs which extend below a crotch area of said garment, said pant legs each having an inseam which extends downwardly to a lower hem edge of each said pant leg, the improvement comprising:

a unitary somewhat tight fitting lower torso undergarment having a concealed closeable opening which extends only along a portion of the inseam substantially centrally through the crotch opening toward, but not to, each said lower hem edge, said closeable opening having a maximum length sufficient to permit the wearer to urinate through said closeable opening without the need for even partial removal or further dismantling of said garment.

4. In combination, a substantially unitary pants-suit type outer garment for women which covers the upper and lower torso of the female wearer and having an upper neck opening and arm openings or sleeves and pant legs, said outer garment pant legs each having a hem edge at a lower end thereof and an inseam which extends through a central crotch area and a substantially unitary undergarment for women which covers the lower torso of the female wearer and having a waist opening and pant legs which extend below a crotch area to cover at least a portion of each upper leg of the wearer, said undergarment pant legs each having an inseam which extends between a hem edge of each said undergarment the improvement of said outer garment and said undergarment comprising:

a first closeable opening of said outer garment extending along said inseam centrally positioned through said outer garment crotch area and downwardly toward but terminating substantially before reaching each said outer garment hem edge, said first closeable opening being of only sufficient length, when manually opened, to permit the wearer to urinate through said first opening while either standing or while resting atop a toilet without further removal or further opening of said outer garment, said first opening being substantially concealed from view when closed;

a second closeable opening of said undergarment which extends along only a portion of the inseam substantially centrally on either side of the crotch area and downwardly toward but terminating substantially before reaching each said undergarment hem edge, said second closeable opening having a maximum length, when manually opened, sufficient to permit the wearer to urinate through said closeable opening without even partial removal or further dismantling of said undergarment, said first and second openings being substantially aligned one to another.

* * * * *